US006053112A

United States Patent [19]

Jones, Jr.

[11] Patent Number: 6,053,112

[45] Date of Patent: Apr. 25, 2000

[54] SHIMMING OF RAILWAY CAR PRIMARY SUSPENSIONS

[75] Inventor: William C. Jones, Jr., Reynoldsburg, Ohio

[73] Assignee: Buckeye Steel Castings Company, Columbus, Ohio

[21] Appl. No.: 09/206,516

[22] Filed: Dec. 7, 1998

[51] Int. Cl.[7] ..... B61F 5/00

[52] U.S. Cl. ..... 105/218.1; 105/157.1; 105/182.1; 105/220; 105/225

[58] Field of Search ..... 105/157.1, 182.1, 105/197.05, 218.1, 219, 220, 221.1, 224.05, 224.1, 225

[56] References Cited

U.S. PATENT DOCUMENTS

| | | | |
|---|---|---|---|
| 4,458,605 | 7/1984 | Herring, Jr. et al. | 105/197 |
| 4,793,047 | 12/1988 | Curtis et al. | 29/407 |
| 5,048,427 | 9/1991 | Dumoulin | 105/199 |
| 5,195,438 | 3/1993 | Dumoulin et al. | 105/199.3 |
| 5,611,284 | 3/1997 | Smith et al. | 105/220 |
| 6,006,674 | 12/1999 | Ahmadian et al. | 105/220 |

*Primary Examiner*—Mark T. Le
*Attorney, Agent, or Firm*—Banner & Witcoff, Ltd.

[57] ABSTRACT

There is disclosed a method for compensating for wheel wear to maintain a constant car floor height above the railroad track where the compensating shim is at all times attached to the railway truck. The method comprises generally the steps of providing a wheel wear compensating shim that, when not being used, is removably attached to the underside of the bearing housing or other suitable location, lifting of the side frame away from the primary suspension, disposing the compensating shim between the side frame and the primary suspension, and finally lowering the side frame back onto the shim and primary suspension. The railway truck can thus be shimmed for wheel wear at any location where the side frame and accompanying car body can be lifted without the need to take the railcar to a retrofit service shop.

12 Claims, 2 Drawing Sheets

SHIMMING OF RAILWAY CAR PRIMARY SUSPENSIONS

BACKGROUND OF THE INVENTION

1. Field of Invention

The present invention relates in general to improved trucks for railway cars. More specifically, but without restriction to the particular use which is shown and described, this invention relates to chevron shimming of the railcar's primary suspension.

2. Description of the Related Art

It is known that shimming a railcar's primary suspension compensates for railcar floor height loss when the railcar wheels become worn. It is also known that several methods for compensating for the loss of railcar height due to wheel wear can be utilized. For example, for rapid transit railcars which utilize chevron rubber springs, mounted directly into the truck frame, as the primary spring elements, shims may be applied under the side bearing load pad or at the central bearing if the truck has one. Another common method of shimming for wheel wear is to apply shims between the chevron spring and the truck frame. With this method, thin steel sheets bent to the same angle as the chevron springs are disposed between the chevron spring and the truck frame. However, with the aforementioned methods, the shims applied to compensate for wheel wear are separate items not readily available, are frequently lost in the retrofitting service shops, or are erroneously selected resulting in uncorrected railcar floor height.

Still another method for compensating for wheel wear includes trucks with the primary suspension having a chevron block between the chevron springs and the truck frame. While it is customary to shim at the side bearing load pad, it is also possible to place thin shims between the back of the chevron block and the truck frame. This brings the inside faces of the blocks closer together, which, due to the mating faces of the block and springs being on an angle, causes the block to seat on the springs sooner, thereby causing the truck frame to sit higher above the rail. Here again, the shims are separate items that can be lost or improperly selected.

Yet another method for wheel wear compensation includes adding shims between the top of the shelf extending out from the side of the wheel bearing housing and the bottom of the chevron spring. Again with this method, the shims are not readily available on the truck.

Still another method involves adding the shims between the bottom pedestal toe of the truck frame and the top surface of the lower portion of the chevron adapter. With this arrangement, it is necessary to remove the tie bar in order to apply the shims. As above, the shims are not readily available on the truck and are easily misplaced or improperly selected.

Shims on railway trucks are also used on the top of the bearing adapter and the bottom of the truck frame to maintain a given distance for the safety stop. This is done to keep from overextending the chevron spring and to insure that the working clearances in the truck will be maintained. Again, as with all the traditional methods of shimming for wheel wear, these shims are not carried with the truck, are frequently lost, or are simply not readily available.

SUMMARY OF THE INVENTION

Accordingly, an object of the present invention is to overcome the aforementioned problems associated with shimming railway trucks for wheel wear. Another object of the invention is to provide a shim that is carried by the railway truck. Still another object is to provide a shim that is mounted to the truck and has a predetermined thickness for proper wheel wear compensation. Yet another object of the present invention is to provide a method of compensating for wheel wear where the compensating shim is carried along with the truck, therefore, preventing the loss or misplacement of the shim.

Briefly stated, in summary, the present invention involves a method for compensating for wheel wear to maintain a car floor height within acceptable limits above the railroad track where the compensating shim is at all times attached to the railway truck. The method comprises generally the steps of providing a wheel wear compensating shim that, when not being used, is removably attached to the underside of the bearing housing or other suitable location, lifting of the truck side frame away from the primary suspension, disposing the compensating shim between the side frame and the primary suspension or other suitable shim mounting location, and finally lowering the side frame back onto the primary suspension. The present invention avoids the problems of lost or misplaced shims associated with retrofitting for wheel wear because the shims are always with the railway truck. Moreover, the railway truck can be shimmed for wheel wear at any location where the side frame and accompanying car body can be lifted without the need to take the railcar to a retrofit service shop. In addition, special tools are not required for the shimming, only a means for lifting the side frame and car body sufficiently to remove the load off the chevron springs.

More particularly, when the wheels have worn to the point where it is time to shim the truck in order to maintain the floor or coupler height above the track, the shim bolted to the underside of the bearing housing is removed. The truck side frame is then raised by jacking or using other lifting means until the bearing housing is resting on the tie rod. For railcars that utilize chevron springs, the springs and chevron blocks will fall away from the side frame. The previously removed shim may now be bolted in the chevron block and disposed between the chevron block and the truck side frame. It should be noted that for each chevron block mounted over each worn wheel, a shim is disposed on the chevron block. The truck frame is then lowered back into position, allowing the weight to be carried by the springs, and resulting in the compensation for wheel wear.

The full range of objects, aspects and advantages of the invention are only appreciated by a full reading of this specification and a fill understanding of the invention. Therefore, to complete this specification, a detailed description of the invention and the preferred embodiment follows, after a brief description of the drawing.

BRIEF DESCRIPTION OF THE DRAWING

The preferred embodiment of the invention will be described in relation to the accompanying drawing. In the drawing, the following figures have the following general nature.

In the accompanying drawing, like reference numerals are used throughout the various figures for identical structures.

DESCRIPTION OF THE PREFERRED EMBODIMENTS

Figure 1:
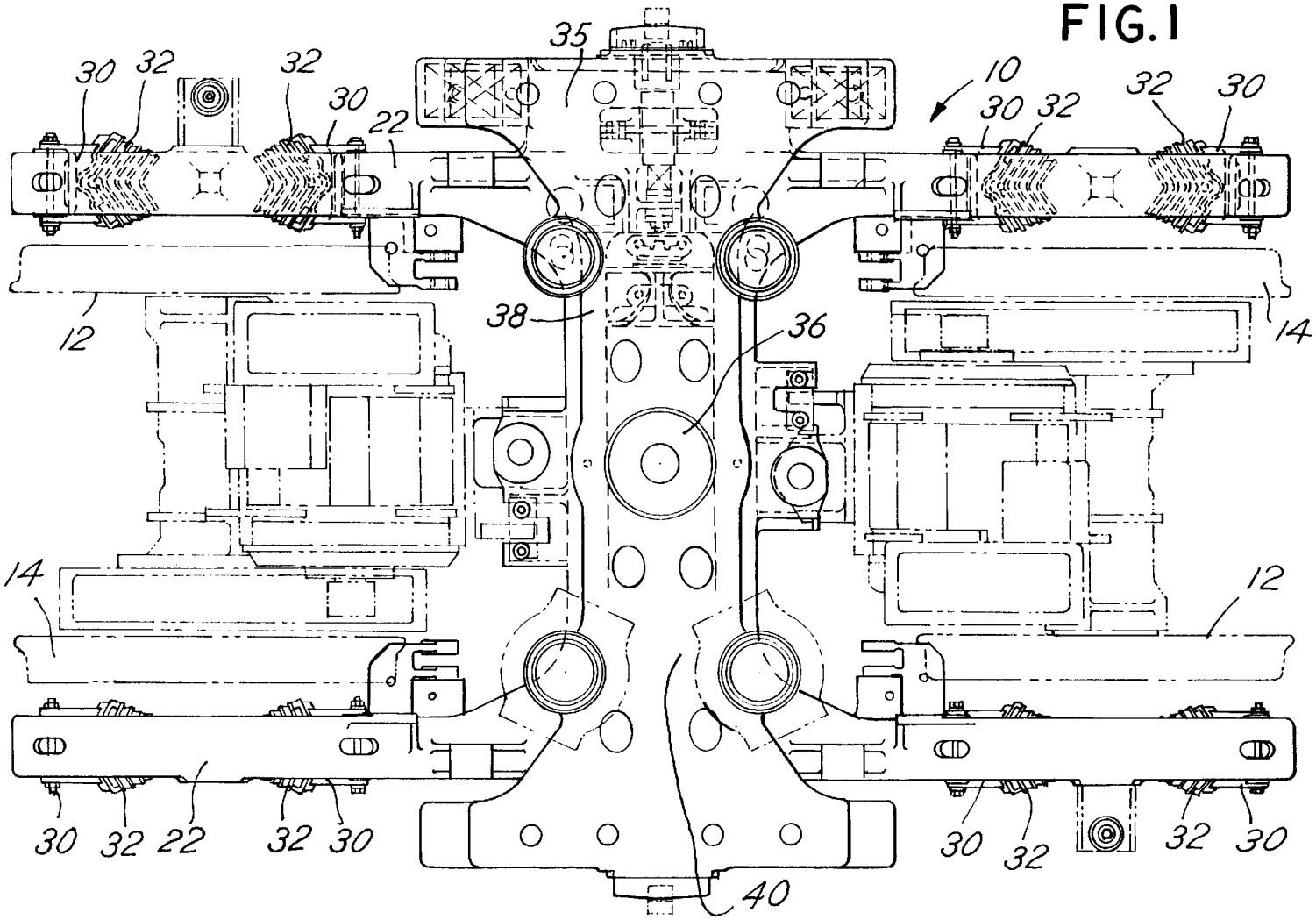
FIG. 1 is a plan view of a railcar truck according to the present invention.

Referring to FIG. 1, a preferred form of a passenger railcar truck, shown in plan view, according to the invention is generally designated 10. The truck is utilized, as typical, in tandem with another identical or substantially similar truck for supporting and transporting one or more passenger railcars on railway rails. As conventional, two trucks support one railcar.

A truck 10 includes conventional wheel sets 12, comprising flanged railway wheels 14, spaced transversely from each other, and joined by a transversely extending axle 16. As conventional, the depicted truck 10 includes two longitudinally spaced wheel sets 12. In service, the wheels 14 follow the rails of the underlying rail line, and in part, maintain transverse relation to the rails through opposed, integral inner wheel flanges. The wheels and axles are separately made of steel and pressed together.

Figure 2:
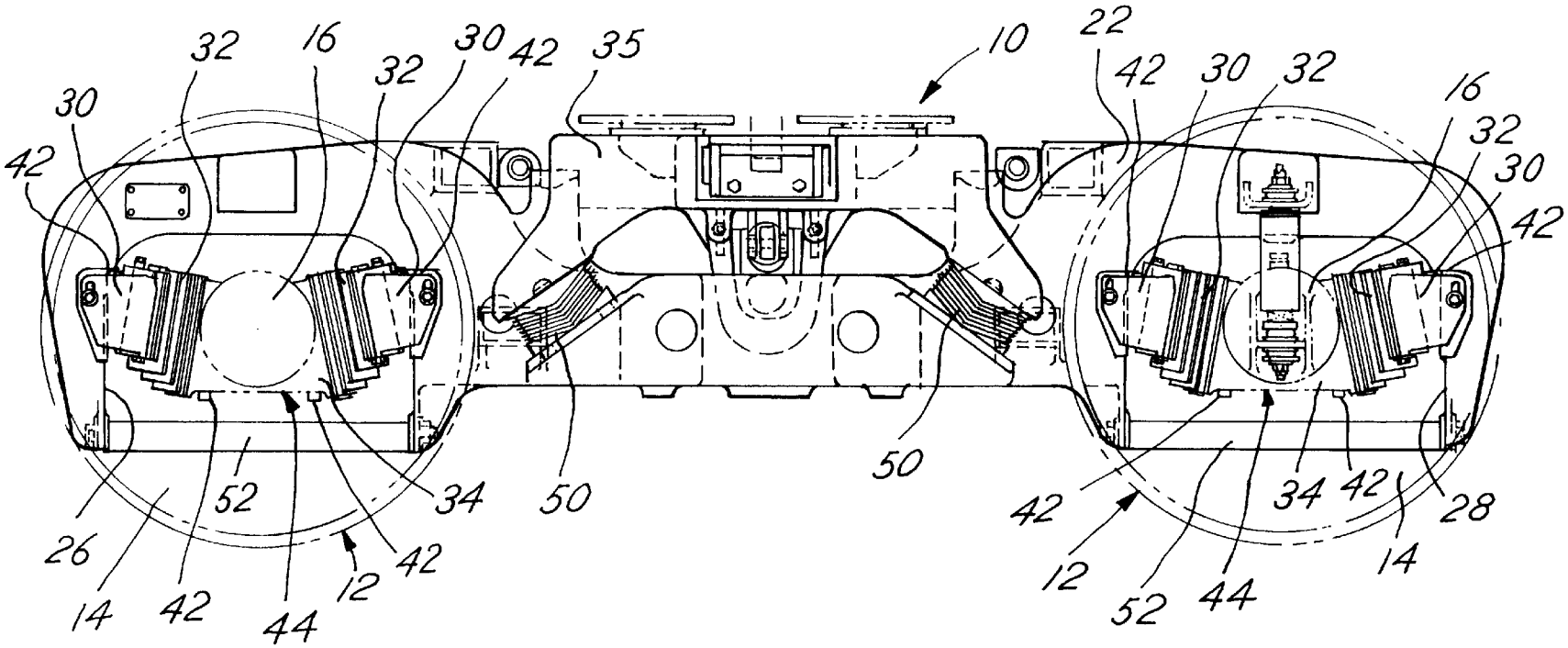
FIG. 2 is a side elevation view of the truck of FIG. 1.

Referring to FIG. 2, transversely spaced truck side frames 22 are supported on the wheel sets 12. The side frames 22 are longitudinally elongated, define longitudinally spaced, downwardly opening pedestal jaws 26, 28. Chevron spring blocks 30 are mounted in the jaws 26, 28, and the blocks receive the rubber chevron springs 32 which serve as the primary railcar suspension. As conventional, two spring blocks 30 and accompanying rubber chevron springs 32 are located within each pedestal jaw 26, 28. The chevron springs 32 are located over each wheel on opposing sides of the wheel axle 16. The chevron springs 32 seat on the journal bearing housings 34 and the bearing housings rotatably receive the journal portions of the axles 16.

Referring to FIGS. 1 and 2, a transversely extending truck bolster 35 extends between and over the truck side frames 22. The truck bolster includes a center bowl 36 and two opposed, elongated bolster arms 38, 40 which extend transversely outward from beneath the center bowl 36. The truck bolster 35 is connected to the side frames by a conventional pnuematic suspension 50, as is well known in the art.

In a preferred embodiment to compensate for wheel wear, thereby maintaining constant car floor height above the track, shims 42 are provided above the chevron spring blocks 30 between the blocks 30 and the side frame 22. The shims 42 are located above each chevron spring block 30 for each wheel set that is worn. When the shims 42 are not being utilized to compensate for wheel wear, the shims are removably fastened, through bolting or pinning, to the bottom 44 of the bearing housing 34, as depicted in FIG. 2. Mounting the shims 42 to the bearing housing 34, or any other suitable structure of the railcar truck, prevents the shims from being lost or misplaced as the shims 42 will always accompany the truck.

When the wheels are profiled or worn a predetermined amount so that it is time to shim for such wheel wear, the shims 42 are removed from the bottom of the bearing housing and are inserted between the chevron blocks 30 and the side frame 22, thus, raising the railcar to the desired height above the track. Shim insertion is accomplished by jacking or raising by other means the side frame 22 up and away from the chevron block 30 until the bearing housing 34 is resting on the tie rod 52 which traverses the pedestal jaw opening. This allows the chevron springs 32 and chevron block 30 to fall away from the side frame 22. The shim 42 that has already been removed from the bottom of the bearing housing may then be bolted or pinned to the chevron block 30 at the point where the side frame 22 mounts to the block 30. The side frame 22 is then lowered back into position allowing the weight to be carried by the chevron springs 32. Upon insertion of the shim 42, wheel wear is compensated for and proper railcar height and working clearances in the truck are maintained.

The preferred embodiment of the invention are now described as to enable a person of ordinary skill in the art to make and use the same. Variations of the preferred embodiment are possible without being outside the scope of the present invention. As an example, other types of shims can be carried along with the truck and there are other locations on the truck assembly where shimming could occur. Moreover, other means for carrying the shim with the truck can be utilized notwithstanding the aforementioned bolting or pinning. Therefore, to particularly point out and distinctly claim the subject matter regarded as the invention, the following claims conclude the specification.

What is claimed is:

1. In a method of compensating for railway truck wheel wear, the railway truck having at least two longitudinally spaced, transversely extending axles, wheels mounted to the axles, bearing housings mounted adjacent the wheels on the axles, chevron springs mounted to the bearing housings, chevron blocks mounted to the chevron springs, transversely spaced longitudinally extending side frames mounted to the chevron blocks, a transversely extending bolster mounted to the side frames, the bolster having a center bowl and opposed, elongated bolster arms extending from the center bowl, the method comprising the steps of:

providing a shim having a predetermined thickness mounted to the railway truck, removing the shim from the railway truck, lifting the side frame up and away from the chevron block, mounting the shim onto the chevron block, lowering the side frame back onto the chevron block, whereby the shim is disposed between the side frame and chevron block to thereby compensate for the wheel wear.

2. The method of claim 1 wherein the shim mounted to the railway truck is mounted to the bearing housing of the railway truck.

3. The method of claim 1 wherein a plurality of shims are mounted to the railway truck, each of the plurality of shims having the same thickness.

4. In a method of compensating for railway truck wheel wear, the railway truck having at least two longitudinally spaced, transversely extending axles, wheels mounted to the axles, bearing housings mounted adjacent the wheels on the axles, chevron springs mounted to the bearing housings, chevron blocks mounted to the chevron springs, transversely spaced longitudinally extending side frames mounted to the chevron blocks, the side frames defining a pair of pedestal jaw openings, tie rods mounted to the side frames across the pedestal jaw openings, a transversely extending bolster mounted to the side frames, the bolster having a center bowl and opposed, elongated bolster arms extending from the center bowl, the method comprising the steps of:

providing at least one shim mounted to the bearing housing of the railway truck, removing the at least one shim from the bearing housing, lifting the side frame on one side of the truck up and away from the chevron blocks mounted to each wheel until the bearing housings for each wheel are resting on the tie rods, mounting the at least one shim onto the chevron blocks, lowering the side frame onto the chevron blocks, whereby the at least one shim is disposed between the side frame and chevron blocks to thereby compensate for the wheel wear.

5. The method of claim 4 wherein the at least one shim is a plurality of shims mounted to the bearing housing, each of the plurality of shims having a different thickness.

6. The method of claim 4 wherein the at least one shim is bolted to the bearing housing, whereby the shim is carried with the railway truck.

7. In a method of compensating for railway truck wheel wear, the railway truck having at least two longitudinally spaced, transversely extending axles, wheels mounted to the axles, bearing housings mounted adjacent the wheels on the axles, springs mounted to the bearing housings, transversely spaced longitudinally extending side frames mounted to the springs, a transversely extending bolster mounted to the side frames, the bolster having a center bowl and opposed, elongated bolster arms extending from the center bowl, the method comprising the steps of:

providing at least one shim, the shim being mounted to the railway truck, removing the at least one shim from the railway truck, lifting the side frame on one side of the truck up and away from the spring mounted to each wheel, disposing the at least one shim between the side frame and the spring, lowering the side frame onto the spring, whereby the at least one shim compensates for the wheel wear.

8. The method of claim 7 wherein the at least one shim is a plurality of shims mounted to the bearing housing, each of the plurality of shims having a different thickness.

9. The method of claim 7 wherein the at least one shim is bolted to the bearing housing, whereby the shim is carried with the railway truck.

10. A railway truck having at least two longitudinally spaced, transversely extending axles, wheels mounted to the axles, bearing housings mounted adjacent the wheels on the axles, springs mounted to the bearing housings, transversely spaced longitudinally extending side frames mounted to the springs, a transversely extending bolster mounted to the side frames, the bolster having a center bowl and opposed, elongated bolster arms extending from the center bowl, the improvement comprising:

a wheel wear compensating shim removably mounted to the underside of the bearing housing, whereby the wheel wear compensating shim is at all times carried with the railway truck and may be disposed between the side frame and the springs to thereby compensate for the wheel wear.

11. The railway truck of claim 10 wherein the wheel wear compensating shim is a plurality of shims mounted to the bearing housing, each of the plurality of shims having a different thickness.

12. The railway truck of claim 10 wherein the wheel wear compensating shim is bolted to the bearing housing.

* * * * *